US010642199B2

(12) United States Patent
Umeda et al.

(10) Patent No.: US 10,642,199 B2
(45) Date of Patent: May 5, 2020

(54) IMAGE FORMING APPARATUS

(71) Applicant: CANON KABUSHIKI KAISHA, Tokyo (JP)

(72) Inventors: Kensuke Umeda, Kawasaki (JP); Shinsuke Kobayashi, Yokohama (JP); Ai Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/175,628

(22) Filed: Oct. 30, 2018

(65) Prior Publication Data

US 2019/0137909 A1 May 9, 2019

(30) Foreign Application Priority Data

Nov. 9, 2017 (JP) ..... 2017-216702

(51) Int. Cl.
*G03G 15/16* (2006.01)
*G03G 15/00* (2006.01)

(52) U.S. Cl.
CPC ..... *G03G 15/1675* (2013.01); *G03G 15/1665* (2013.01); *G03G 15/1695* (2013.01); *G03G 15/657* (2013.01); *G03G 15/6558* (2013.01); *G03G 15/80* (2013.01)

(58) Field of Classification Search
CPC .. G03G 15/80; G03G 15/657; G03G 15/1675; G03G 15/6558; G03G 2215/00409; G03G 2215/00413
See application file for complete search history.

(56) References Cited

U.S. PATENT DOCUMENTS

2001/0048828 A1* 12/2001 Ishii ..... G03G 9/0825 399/281
2012/0051765 A1* 3/2012 Kuroda ..... G03G 15/1675 399/44
2015/0086250 A1* 3/2015 Hara ..... G03G 15/2053 399/322

FOREIGN PATENT DOCUMENTS

JP 06-202495 A 7/1994
JP 2015084084 A 4/2015
JP 2015-099207 A 5/2015

OTHER PUBLICATIONS

JP 06202495 English machine translation, Furuyama, Jul. 22, 1994 (Year: 1994).*

* cited by examiner

*Primary Examiner* — Thomas S Giampaolo, II
(74) *Attorney, Agent, or Firm* — Canon U.S.A., Inc. IP Division

(57) ABSTRACT

An image forming apparatus fixes a toner image on a transfer material at a fixing portion by applying an AC voltage from an AC power source to a fixing unit and includes a conductive pre-transfer guide on a position at which the transfer material nipped by a transfer portion and the fixing portion is in contact therewith. A capacitor and a Zener diode which is connected to the capacitor in parallel and maintains the pre-transfer guide at a predetermined voltage in a state in which a toner image is transferred to the transfer material nipped by the fixing portion and the transfer portion are arranged between the pre-transfer guide and the ground.

15 Claims, 11 Drawing Sheets

FIRST EXEMPLARY EMBODIMENT

FIRST COMPARATIVE EXAMPLE

SECOND COMPARATIVE EXAMPLE

FIG.6

| | SETTING CONDITION | | EVALUATION RESULT | | |
|---|---|---|---|---|---|
| | CAPACITOR CAPACITANCE (pF) | PARALLEL ARRANGEMENT | Vp-p (V) | AC BANDING IMAGE | TRANSFER FAILURE IMAGE |
| FIRST EXEMPLARY EMBODIMENT | 1000 | ZENER DIODE | 130 | ○ | ○ |
| FIRST MODIFICATION | 500 | ZENER DIODE | 150 | ○ | ○ |
| SECOND MODIFICATION | 3300 | ZENER DIODE | 70 | ○ | ○ |
| THIRD MODIFICATION | 4700 | ZENER DIODE | 40 | ○ | △ |
| FIRST COMPARATIVE EXAMPLE | NIL | ZENER DIODE | 200 | × | ○ |
| THIRD COMPARATIVE EXAMPLE | 47000 | RESISTANCE (40 Ω) | 90 | ○ | △ |
| FOURTH COMPARATIVE EXAMPLE | 1000 | NIL | 250 | × | ○ |

FIG.10

| | SETTING CONDITION | | EVALUATION RESULT | |
|---|---|---|---|---|
| | CAPACITOR CAPACITANCE (pF) | PARALLEL ARRANGEMENT | AC BANDING IMAGE | TRANSFER FAILURE IMAGE |
| SECOND EXEMPLARY EMBODIMENT | 1000 | ZENER DIODE | ○ | ○ |
| FIFTH COMPARATIVE EXAMPLE | NIL | ZENER DIODE | × | ○ |
| SIXTH COMPARATIVE EXAMPLE | 1000 | NIL | × | ○ |
| SEVENTH COMPARATIVE EXAMPLE | 10000 | NIL | ○ | × |

IMAGE FORMING APPARATUS

BACKGROUND OF THE INVENTION

Field of the Invention

The present invention relates to an image forming apparatus using an electrophotographic method and an electrostatic recording method, such as a copying machine, a printer, and a facsimile apparatus.

Description of the Related Art

An image forming apparatus using the electrophotographic method applies a transfer voltage to a transfer member arranged to face an image bearing member such as a drum type photosensitive member and an intermediate transfer member and thus electrostatically transfers a toner image borne by the image bearing member to a transfer material such as paper and an overhead projector (OHP) sheet. Subsequently, the transfer material on which the toner image is transferred at a transfer portion formed by the image bearing member and the transfer member is conveyed to a fixing unit and heated and pressed by the fixing unit, so that the toner image is fixed to the transfer material. The fixing unit includes a heating member such as a heater and a pressing member which forms a fixing nip portion by coming into pressure contact with the heating member, and the heating member is applied with an alternate current (AC) voltage from an AC power source and thus heated to a temperature at which the toner image can be transferred to the transfer material.

When the image forming apparatus as described above uses a transfer material of which electrical resistance is reduced because it has been left in a high temperature and high humidity environment and the like for a long time and absorbed moisture, there is a possibility that a following image defect occurs. When the transfer material is nipped by the fixing nip portion in a state in which a toner image is being transferred, an AC voltage is superposed on a transfer voltage via the transfer material at the transfer portion, the AC voltage varies the transfer voltage at the transfer portion. Accordingly, an electric current flowing from the transfer member toward the image bearing member is fluctuated by a waveform component of the AC voltage, transferability is influenced, and an image defect of density unevenness (hereinbelow, referred to as AC banding) may occur in a sub-scanning direction of the image as a result.

Japanese Patent Application Laid-Open No. 2015-84084 describes a configuration in which a conductive member being in contact with a transfer material nipped by a fixing nip portion and a transfer portion is provided, and a resistance element and a capacitor are connected in parallel and arranged between the conductive member and ground. In the configuration according to Japanese Patent Application Laid-Open No. 2015-84084, the capacitor can attenuate a waveform component of an AC voltage applied from the transfer portion to the fixing nip portion via the transfer material.

In the configuration according to Japanese Patent Application Laid-Open No. 2015-84084, capacitance of the capacitor connected to the conductive member may be increased to more effectively reduce AC banding. However, when the capacitance of the capacitor is increased, an electric current for transferring a toner image to the transfer material nipped by the transfer portion flows from the transfer member into the capacitor via the transfer material and the conductive member, and thus an image defect may occur because the electric current necessary for transferring the toner image is insufficient.

SUMMARY OF THE INVENTION

The present invention is directed to more effective suppression of an image defect occurring when an AC voltage is superposed on a transfer voltage via a transfer material.

An image forming apparatus according to the present invention includes an image bearing member configured to bear a toner image, a transfer member configured to form a transfer portion by abutting on the image bearing member and transfer a toner image born by the image bearing member to a transfer material at the transfer portion, a fixing unit which is disposed on a downstream side than the transfer member in a conveyance direction of the transfer material and is configured to include a heating member configured to heat the transfer material and a pressing member configured to form a fixing portion by being in contact with the heating member and to transfer the toner image to the transfer material nipped by the fixing portion by being applied with an alternate current (AC) voltage, a conductive member arranged on an upstream side of the fixing portion in the conveyance direction of the transfer material and on a position at which the transfer material nipped by the transfer portion and the fixing portion is in contact thereto, a capacitor disposed between the conductive member and ground, and a constant voltage element which is connected to the capacitor in parallel and is maintained at a predetermined voltage on a side connected to the conductive member in a state in which the toner image is transferred to the transfer material nipped by the fixing portion and the transfer portion.

Further features of the present invention will become apparent from the following description of exemplary embodiments with reference to the attached drawings.

BRIEF DESCRIPTION OF THE DRAWINGS

FIG. 6 is a table showing image evaluation results according to the first exemplary embodiment, a first modification, a second modification, a third modification, the first comparative example, the third comparative example, and a fourth comparative example.

FIG. 10 is a table showing image evaluation results according to the second exemplary embodiment, a fifth comparative example, a sixth comparative example, and a seventh comparative example.

DESCRIPTION OF THE EMBODIMENTS

Various exemplary embodiments of the present invention will be described in detail below with reference to the attached drawings. However, dimensions, materials, and shapes of components and their relative arrangement described in the exemplary embodiments are to be appropriately changed depending on a configuration and various conditions of an apparatus to which the present invention is applied. Thus, if not specifically mentioned, the scope of the present invention is not limited only to such dimensions, materials, shapes and relative arrangement.

[Configuration of Image Forming Apparatus]

Figure 1:
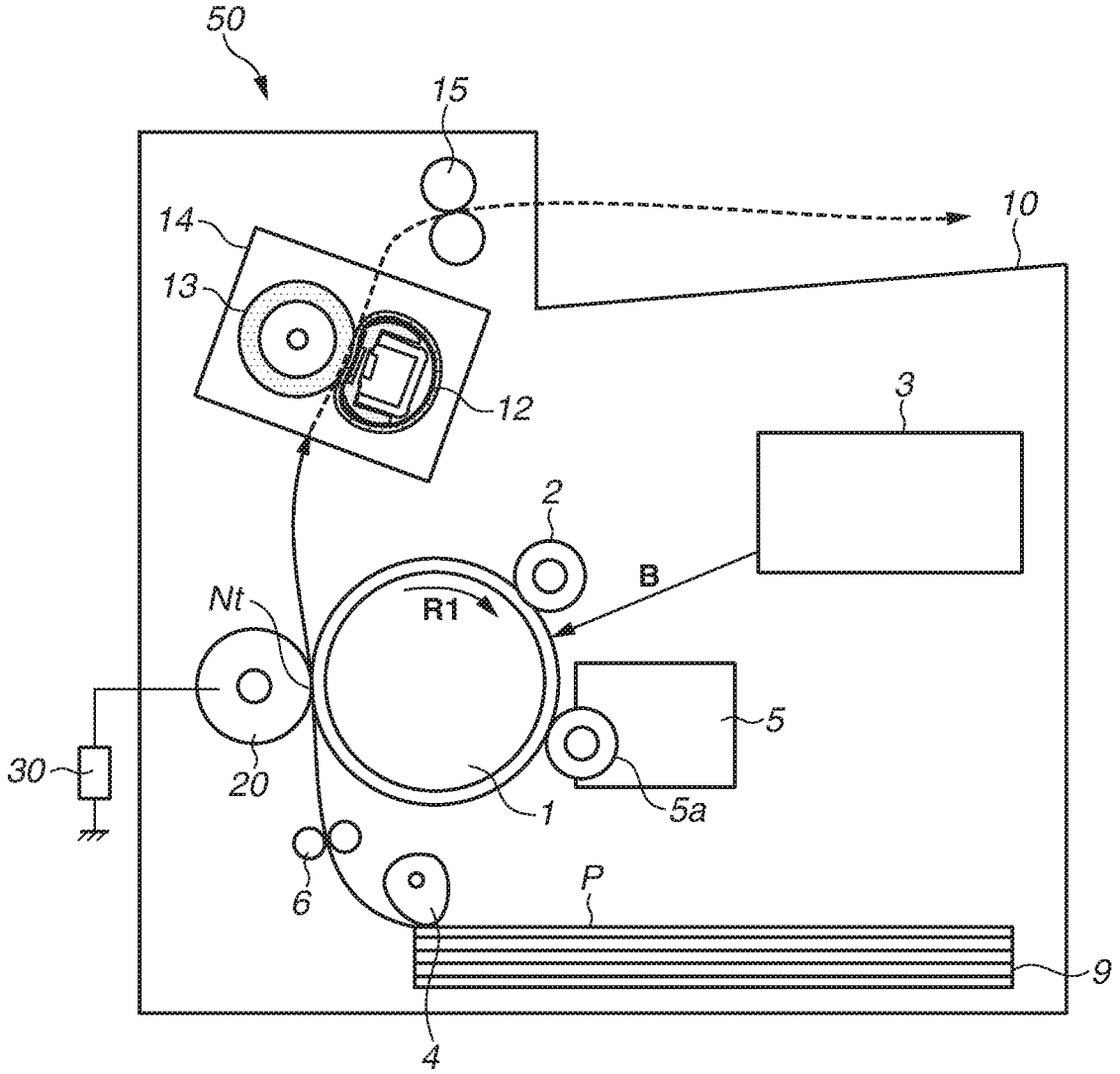
FIG. 1 is a cross-sectional view illustrating a configuration of an image forming apparatus according to a first exemplary embodiment.

FIG. 1 is a schematic cross-sectional view illustrating a configuration of an image forming apparatus 50 according to a first exemplary embodiment. As illustrated in FIG. 1, the image forming apparatus 50 according to the present exemplary embodiment includes a photosensitive drum 1 (an image bearing member) which is a drum type photosensitive member, and the photosensitive drum 1 receives a driving force from a driving source not illustrated and is driven and rotated in an arrow R1 direction shown in the drawing at a predetermined peripheral speed.

A charging roller 2 as a charging unit, an exposure unit 3 which irradiates the photosensitive drum 1 with a laser beam B, and a developing unit 5 including a developing roller 5*a* as a developing member are arranged around the photosensitive drum 1. The developing unit 5 stores toner, and the developing roller 5*a* can bear the toner stored in the developing unit 5 by being applied with a voltage having a polarity opposite to a normal charge polarity of the toner from a developing power source not illustrated.

A transfer roller 20 as a transfer member for forming a transfer portion Nt by abutting on the photosensitive drum 1 is arranged on a position facing the photosensitive drum 1. According to the present exemplary embodiment, the transfer roller 20 having an outer diameter of 14 mm is used in which a nickel-plated steel bar having an outer diameter of 8 mm is covered with a foam sponge body which is comprised mainly nitril butadiene rubber (NBR) and epichlorohydrin rubber and has a thickness of 3 mm and volume resistivity of approximately 108 Ω·cm. The transfer roller 20 abuts on the photosensitive drum 1 at a pressure of approximately 1 kg and rotates by following rotation of the photosensitive drum 1.

The transfer roller 20 is connected to a transfer power source 30, and a toner image can be transferred from the photosensitive drum 1 to a transfer material P at the transfer portion Nt by applying a voltage from the transfer power source 30 to the transfer roller 20. In the following description, a voltage formed at the transfer portion Nt for transferring a toner image from the photosensitive drum 1 to the transfer material P is referred to as a transfer voltage.

A fixing unit 14 including a pressing roller 13 as a pressing member and a heating member 12 is disposed on a downstream side of the transfer portion Nt in a conveyance direction of the transfer material P. The image forming apparatus 50 further includes a sheet feeding cassette 9 as a storage unit for storing the transfer material P such as paper and an OHP sheet and a sheet discharge tray 10 as a stacking unit for stacking the transfer material P discharged from the image forming apparatus 50 after an image is formed thereon.

Next, an image forming operation according to the present exemplary embodiment is described with reference to FIG. 1. When a control unit not illustrated receives an image signal, and an image forming operation is started, the photosensitive drum 1 is driven and rotated in the arrow R1 direction shown in FIG. 1. The photosensitive drum 1 is uniformly charged to a predetermined potential in a rotation process by the charging roller 2 which is applied with a voltage having a predetermined polarity (a negative polarity according to the present exemplary embodiment) by a charging power source not illustrated. Subsequently, the photosensitive drum 1 is exposed to light corresponding to the image signal by the exposure unit 3, and thus an electrostatic latent image corresponding to a target image is formed on a surface of the photosensitive drum 1.

The electrostatic latent image formed on the photosensitive drum 1 is developed at a development position at which the developing roller 5*a* bearing the toner abuts on the photosensitive drum 1 and visualized as a toner image on the photosensitive drum 1. According to the present exemplary embodiment, a normal charging polarity of the toner stored in the developing unit 5 is a negative polarity, and the electrostatic latent image is reversely developed by the toner charged to the same polarity as the charge polarity of the photosensitive drum 1 by the charging roller 2. However, the present invention can be applied to an image forming apparatus which positively develops an electrostatic latent image by toner charged to a polarity opposite to the charging polarity of the photosensitive drum 1 without being limited to the above-described exemplary embodiment.

A voltage having a polarity (a positive polarity according to the present exemplary embodiment) opposite to the normal charge polarity of the toner is applied from the transfer power source 30 to the transfer roller 20, and thus the toner image formed on the photosensitive drum 1 is transferred to the transfer material P supplied from the sheet feeding cassette 9 at the transfer portion Nt. The transfer material P stored in the sheet feeding cassette 9 is supplied by a feeding roller 4 and then conveyed to the transfer portion Nt by a conveyance roller 6.

The image forming apparatus 50 according to the present exemplary embodiment has a cleaner-less configuration in which toner remaining on the photosensitive drum 1 after the toner image is transferred from the photosensitive drum 1 to the transfer material P is collected by the developing unit 5.

In the cleaner-less configuration, a collection member such as a blade abutting on the photosensitive drum 1 is not disposed between the transfer portion Nt and a charging portion at which the photosensitive drum 1 abuts on the charging roller 2 in a rotation direction of the photosensitive drum 1. Thus, the toner remaining on the photosensitive drum 1 after passing through the transfer portion Nt is charged again to the negative polarity when passing through the charging portion and then is collected by the developing unit 5 at the development position at which the developing roller 5*a* abuts on the photosensitive drum 1.

The transfer material P on which the toner image is transferred at the transfer portion Nt is conveyed to the fixing unit 14 and heated and pressed by the heating member 12 and the pressing roller 13 in the fixing unit 14, so that the toner image is fixed to the transfer material P. The transfer material P on which the toner image is fixed by the fixing unit 14 is then discharged to the sheet discharge tray 10 by a pair of sheet discharge rollers 15. Thus, an image is formed on a transfer material P by the above-described operations in the image forming apparatus 50 according to the present exemplary embodiment.

[Fixing Unit]

Figure 2:
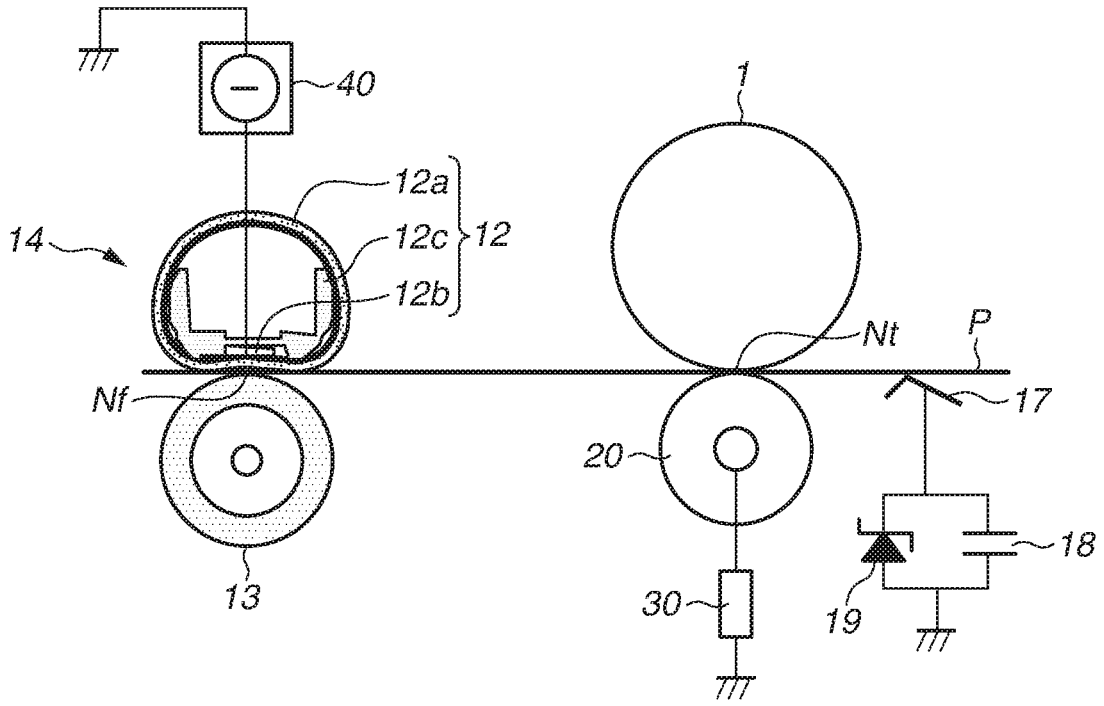
FIG. 2 is a schematic diagram illustrating a peripheral configuration of a transfer portion and a fixing unit according to the first exemplary embodiment.

FIG. 2 is a schematic diagram illustrating a peripheral configuration of the transfer portion Nt and the fixing unit 14 according to the present exemplary embodiment. A configuration of the fixing unit 14 is described below with reference to FIG. 2. As illustrated in FIG. 2, the fixing unit 14 includes the pressing roller 13 as a pressing member and the heating member 12. The pressing roller 13 presses the heating member 12, and thus a fixing portion Nf is formed which can nip the transfer material P on which the toner image is transferred.

The heating member 12 includes a film 12*a* formed by a flexible endless belt, a plate shape heater 12*b* (a heating element) being in contact with an inner circumferential surface of the film 12*a* at a position facing the pressing roller 13 via the film 12*a*, and a support portion 12*c* supporting the heater 12*b*. According to the present exemplary embodiment, the film 12*a* has an approximately cylinder shape when being not deformed, and an outer diameter thereof is 18 mm.

The film 12*a* is a cylindrical flexible member including a base layer having a thickness of 60 μm in which a thermally conductive filler is dispersed in polyimide resin, an elastic layer having a thickness of 4 μm in which conductive carbon is dispersed in fluororesin, and a release layer having a thickness of 15 μm in which a conductivity imparting substance is dispersed in fluororesin. In this regard, a layer having a thickness of 30 to 80 μm, a layer having a thickness of 1 to 6 μm, and a layer having a thickness of 5 to 30 μm can be respectively used as a base layer, an elastic layer, and a release layer.

The heater 12*b* is configured in such a manner that a resistance heat generating element made of silver alloy as a heat generating element is printed on an alumina substrate, and glass coating is applied to a surface of the resistance heat generating element and is provided with a thermistor (not illustrated) as a temperature detection element. The heater 12*b* generates heat when an AC voltage is applied from an AC power source 40 to the resistance heat generating element as the heat generating element, and the control unit (not illustrated) which comprehensively controls operations of the image forming apparatus 50 controls AC voltage supply to the heater 12*b* and temperature adjustment of the heater 12*b*.

The pressing roller 13 is a roller member having an outer diameter of 18 mm which includes a heat-resistant elastic layer made of silicone rubber and the like provided on an outer circumferential surface of a metal core, and a release layer made of a material having high releasability such as fluororesin is provided on an outermost layer of the pressing roller 13. The pressing roller 13 is pressed toward the heating member 12 by a pressing spring (not illustrated) as an urging member.

When the pressing roller 13 is driven and rotated by receiving a driving force from a driving source not illustrated, a rotation force is applied to the film 12*a* by a pressure contact frictional force between the pressing roller 13 and the film 12*a* at the fixing portion Nf. Accordingly, the film 12*a* rotates following the rotation of the pressing roller 13 while sliding an inner circumferential surface thereof on the heater 12*b*.

The transfer material P is introduced into the fixing portion Nf in a state in which the film 12*a* and the pressing roller 13 rotate, the AC voltage from the AC power source 40 is applied to the heater 12*b*, and a detection temperature of the thermistor (not illustrated) of the heater 12*b* reaches a target temperature. The toner image transferred to the transfer material P at the transfer portion Nt is heated and pressed in a process in which the transfer material P passes through the fixing portion Nf and melted and fixes to the transfer material P. The transfer material P passing through the fixing portion Nf is separated from the film 12*a* by a curvature of the film 12*a* and discharged to the sheet discharge tray 10 by the pair of sheet discharge rollers 15.

The glass (glass coating) which coats the resistance heat generating element in the heater 12*b* is electrically regarded as a capacitor, and capacitance thereof is several hundred pF (100 to 600 pF). Thus, the AC voltage from the AC power source 40 is transmitted from the resistance heat generating element to the transfer material P at the fixing portion Nf via the glass.

A distance from the transfer portion Nt to the fixing portion Nf in the image forming apparatus 50 according to the present exemplary embodiment is approximately 40 mm in the conveyance direction of the transfer material P. Thus, when an image is formed on a transfer material P having a normal A4 size or letter size, the toner image is transferred from the photosensitive drum 1 to the transfer material P at the transfer portion Nt at the same time when the toner image is fixed to the transfer material P at the fixing unit 14.

[Mechanism for Generating AC Banding Image]

Next, an image defect is described which is generated when an image is formed on a transfer material P having low electrical resistance such as a moisture absorbed transfer material P. When a transfer material P having low electrical resistance such as paper left in a high temperature and high humidity environment (temperature of 30 degrees C. and humidity of 80%) is used, there is a possibility that the AC voltage applied to the heating member 12 is transmitted from the fixing portion Nf to a transfer portion Vt via the transfer material P. When the AC voltage of the AC power source 40 is superposed on a transfer voltage applied to the transfer roller 20 at the transfer portion Nt, an electric current flowing from the transfer roller 20 toward the photosensitive drum 1 is fluctuated by a waveform component of the AC voltage.

Accordingly, an image defect (hereinbelow, referred to as an AC banding image) due to density unevenness may be generated in the toner image to be transferred from the photosensitive drum 1 to the transfer material P at the transfer portion Nt in some cases. Thus, according to the present exemplary embodiment, generation of an AC banding image is suppressed by a configuration described below.

[Configuration for Suppressing Generation of AC Banding Image]

As illustrated in FIG. 2, a pre-transfer guide 17 as a guide member for guiding the transfer material P to the transfer portion Nt is provided on an upstream side of the transfer portion Nt in the conveyance direction of the transfer material P. In addition, a capacitor 18 as a capacitance element and a Zener diode 19 as a constant voltage element are connected in parallel between the pre-transfer guide 17 and the ground. The pre-transfer guide 17 is a conductive member to be in contact with the transfer material P nipped between the transfer portion Nt and the fixing portion Nf, and according to the present exemplary embodiment, the one formed by a metal member is used as the pre-transfer guide 17.

According to the present exemplary embodiment, the pre-transfer guide 17 is arranged so that the transfer material P is in contact with the pre-transfer guide 17 until a trailing edge of an image forming area of the transfer material P passes through the transfer portion Nt in the conveyance direction of the transfer material P. In other words, at a timing when the transfer material P is separated from the pre-transfer guide 17, a margin portion on the trailing edge of the transfer material P is placed at the transfer portion Nt. More specifically, according to the present exemplary embodiment, the pre-transfer guide 17 is arranged so that a distance from a most downstream contact position at which the pre-transfer guide 17 can be in contact with the transfer material P to the transfer portion Nt is 6 mm in the conveyance direction of the transfer material.

The Zener diode 19 as a constant voltage element is an element for maintaining a predetermined voltage (hereinbelow, referred to as a breakdown voltage) when an electric current flows therethrough, and, when a certain electric current or more flows, the breakdown voltage is generated on a cathode side. In the configuration according to the present exemplary embodiment, one end side (an anode side) of the Zener diode 19 is electrically connected to the ground, and the other end side (the cathode side) is connected to the pre-transfer guide 17. Thus, when a certain electric current or more flows through the Zener diode 19, the pre-transfer guide 17 is maintained at the breakdown voltage of the Zener diode 19.

Figure 3A:
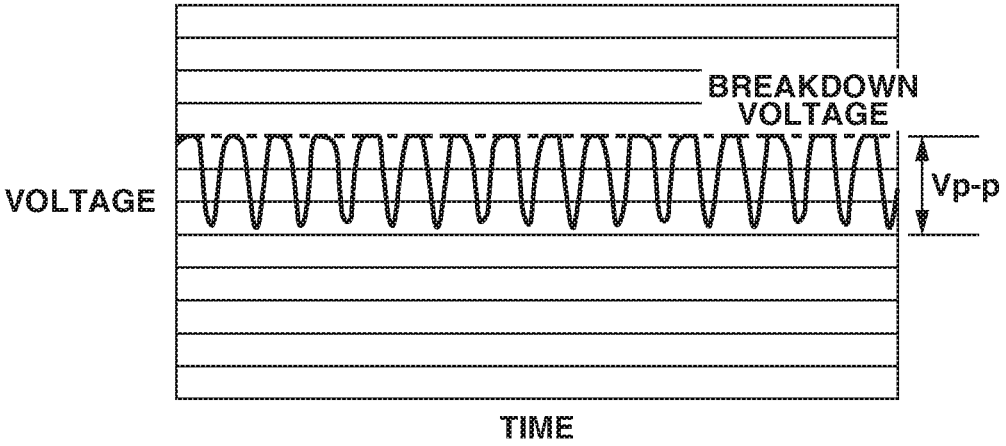
FIGS. 3A to 3C are schematic diagrams illustrating voltage waveforms of a conductive member when an alternate current (AC) voltage is superposed on a transfer voltage according to the first exemplary embodiment, a first comparative example, and a second comparative example.
Figure 3B:
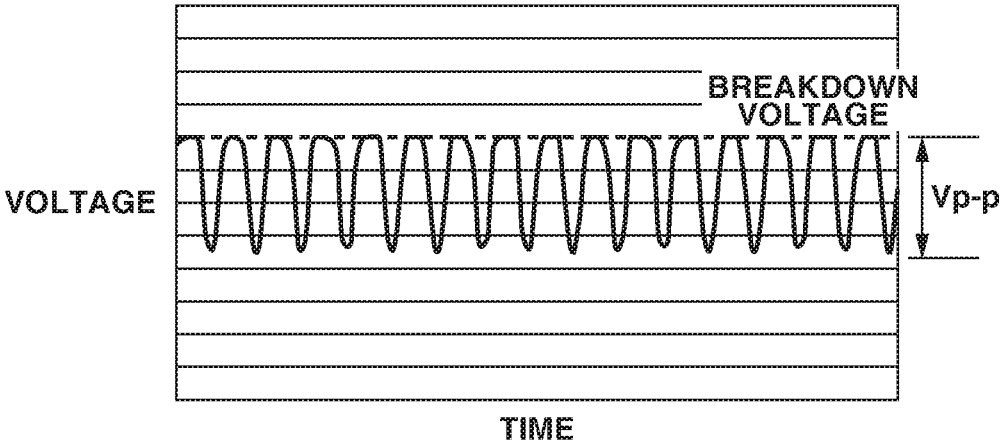
Figure 3C:
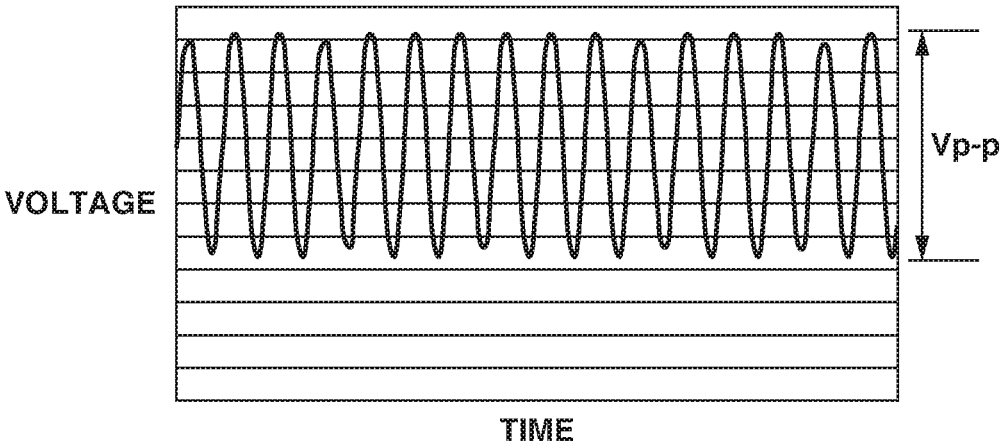

FIG. 3A is a schematic diagram illustrating a voltage waveform measured when the AC voltage from the AC power source 40 is superposed on the transfer voltage at the transfer portion Nt in the configuration according to the present exemplary embodiment. Further, FIGS. 3B and 3C are schematic diagrams respectively illustrating a voltage waveform measured when the AC voltage from the AC power source 40 is superposed on the transfer voltage at the transfer portion Nt in a first comparative example and a second comparative example according to the present exemplary embodiment. In this regards, the first comparative example includes a configuration in which only the Zener diode is connected to the pre-transfer guide 17 with respect to the present exemplary embodiment, and the second comparative example includes a configuration in which the capacitor 18 and the Zener diode 19 are not connected, and the pre-transfer guide 17 is electrically connected to the ground with respect to the present exemplary embodiment.

As illustrated in FIGS. 3A and 3B, when the pre-transfer guide 17 is connected to the Zener diode 19, an amplitude Vp-p of the AC voltage from the fixing portion Nf can be reduced. This is because, when the transfer voltage is fluctuated by the AC voltage, the Zener diode 19 flows the electric current to the ground to maintain a voltage of the breakdown voltage or more at the breakdown voltage. Further, according to the present exemplary embodiment, the capacitor 18 is connected, and thus a waveform component of the AC voltage can be attenuated.

On the other hand, as illustrated in FIG. 3C, the amplitude Vp-p is increased since the AC voltage of the AC power source 40 is superposed on the transfer voltage in the configuration according to the second comparative example. Accordingly, an electric current flowing from the transfer roller 20 to the photosensitive drum 1 is fluctuated, and an AC banding image is generated.

When a voltage is applied from the transfer power source 30 to the transfer roller 20 so as to transfer a toner image from the photosensitive drum 1 to the transfer material P in a high temperature and high humidity environment (temperature of 30 degrees C. and humidity of 80%), the Zener diode 19 is required to maintain the pre-transfer guide 17 at the breakdown voltage. In other words, it is necessary to use the Zener diode 19 which can maintain the cathode side at the breakdown voltage by an electric current flowing from the transfer portion Nt to the Zener diode 19 via the transfer material P having low electrical resistance and the pre-transfer guide 17.

According to the present exemplary embodiment, the transfer voltage formed at the transfer portion Nt is set to 400 V to transfer a toner image from the photosensitive drum 1 to the transfer material P in the high temperature and high humidity environment. Further, an output value of a voltage applied from the transfer power source 30 to the transfer roller 20 is set to 800 V to form the transfer voltage of 400 V at the transfer portion Nt. At that time, for example, when the breakdown voltage of the Zener diode 19 is set to 800 V, a value of the breakdown voltage is greater than that of the transfer voltage, and thus there is a possibility that the breakdown voltage is not formed on the cathode side of the Zener diode 19 if the AC voltage is superposed on the transfer voltage. Accordingly, an effect of attenuating the waveform component of the AC voltage by arranging the Zener diode 19 cannot be obtained.

The breakdown voltage of the Zener diode 19 is desirable to be set to the same level as the transfer voltage necessary for transferring a toner image from the photosensitive drum 1 to the transfer material P in the high temperature and high humidity environment and is set to 400 V according to the present exemplary embodiment. According to such a setting, the pre-transfer guide 17 can be maintained at the transfer voltage when an electric current flows from the transfer portion Nt to the Zener diode 19 via the transfer material P and the pre-transfer guide 17 in the high temperature and high humidity environment. Accordingly, an electric current flowing from the transfer roller 20 to the photosensitive drum 1 can be suppressed from excessively leaking.

More specifically, for example, when the breakdown voltage is set to 200 V, an electric current leaks from the transfer portion Nt at which the transfer voltage of 400 V is formed to the pre-transfer guide 17 maintained at the breakdown voltage of 200 V via the transfer material P having low electrical resistance. Accordingly, the voltage is dropped at the transfer portion Nt, and it is difficult to maintain the transfer voltage necessary for transferring a toner image from the photosensitive drum 1 to the transfer material P, so that an image defect may be generated due to transfer defect.

Thus, it is necessary to set the breakdown voltage of the Zener diode 19 so as not to make an excessively large potential difference between the transfer voltage formed at the transfer portion Nt and the breakdown voltage of the Zener diode 19 in the high temperature and high humidity environment. Generally, when a potential difference is approximately 100 V, leakage of an electric current may occur, and thus it is more desirable that the breakdown voltage of the Zener diode 19 is set to 300 V or more in the configuration of the image forming apparatus 50 according to the present exemplary embodiment.

Figure 4:
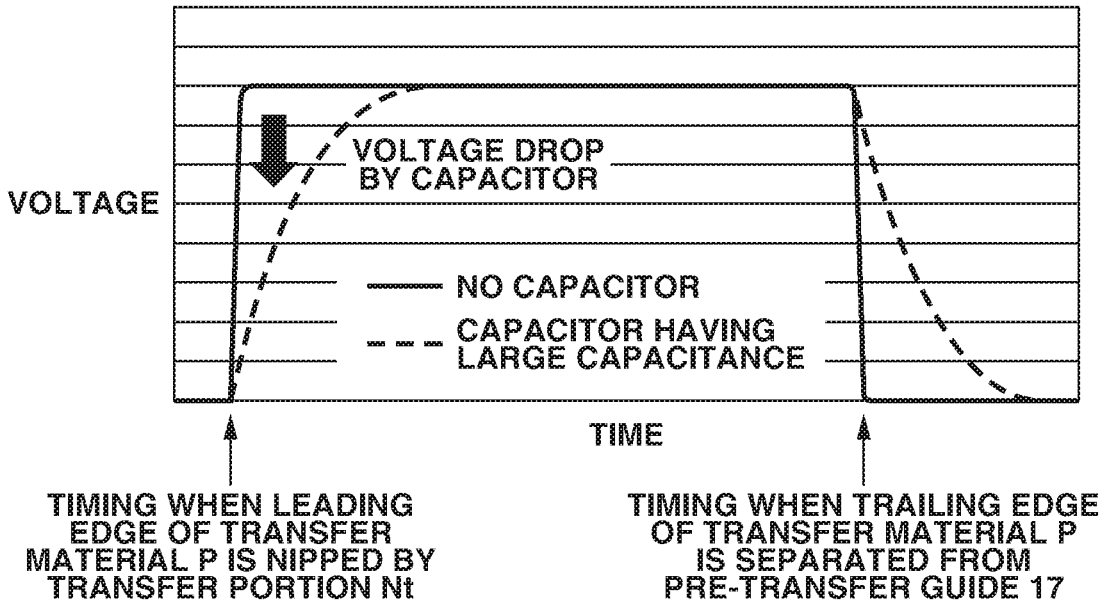
FIG. 4 is a schematic diagram illustrating a relationship between capacitance of a capacitor and a rise in voltage in a conductive member.

FIG. 4 is a schematic diagram illustrating a relationship between a time and the breakdown voltage formed on the pre-transfer guide 17 by arrangement of the capacitor 18. A voltage of the pre-transfer guide 17 is formed by an electric current flowing via the transfer material P at a moment when a leading edge of the transfer material P enters the transfer portion Nt in the conveyance direction of the transfer material P. As the capacitance of the capacitor 18 connected in parallel to the Zener diode 19 becomes greater, an electric current flowing into the capacitor 18 via the transfer material P is increased, and as illustrated in FIG. 4, a rise in voltage formed on the pre-transfer guide 17 is delayed.

A phenomenon that a rise in voltage is delayed as described above occurs not only in the pre-transfer guide 17 but also in the transfer portion Nt. As illustrated in FIG. 3A, the waveform component of the AC voltage can be attenuated by arranging the capacitor 18, and in addition, the waveform component of the AC voltage can be further attenuated by increasing the capacitance of the capacitor 18. However, as the capacitance of the capacitor 18 is increased, a rise in the transfer voltage at the transfer portion Nt is delayed, and an image defect is likely to occur due to a shortage of the transfer voltage at the leading edge side in the conveyance direction of the transfer material P. According to the present exemplary embodiment, the capacitance of the capacitor 18 is set to 1000 pF which has less influence on a rise in the transfer voltage at the transfer portion Nt.

Figure 5:
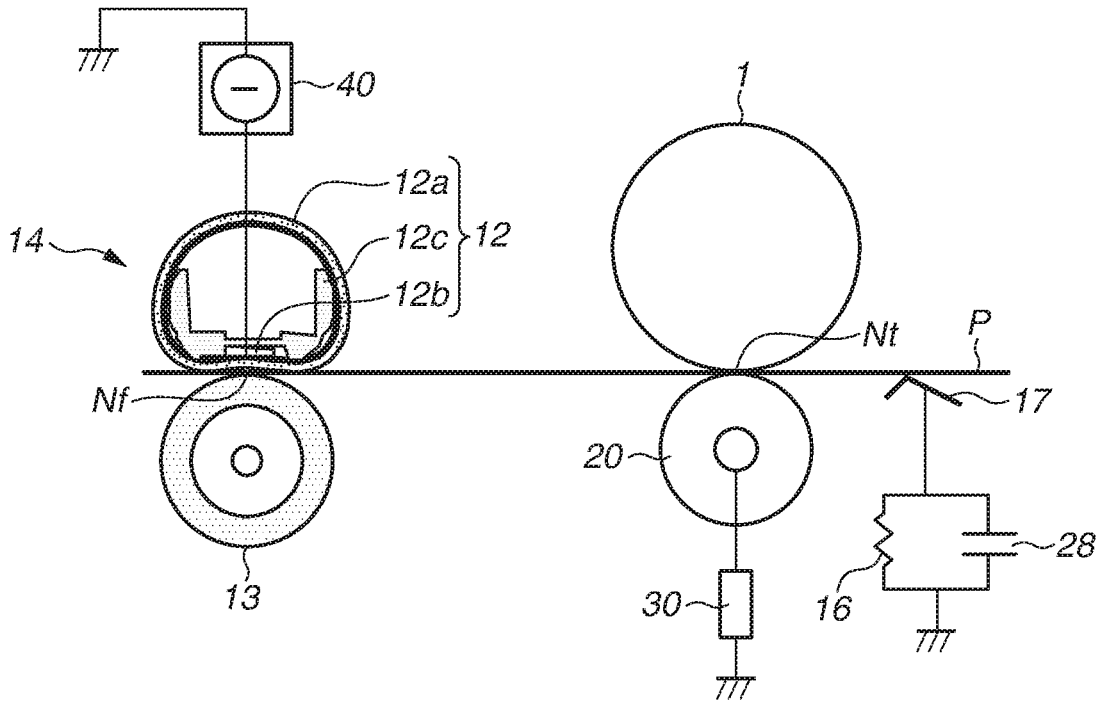
FIG. 5 is a schematic diagram illustrating a configuration according to a third comparative example.

FIG. 5 is a schematic diagram illustrating a configuration of a third comparative example according to the present exemplary embodiment. As illustrated in FIG. 5, a resistance 16 and a capacitor 28 are connected in parallel and arranged between the pre-transfer guide 17 and the ground in the third comparative example. The resistance 16 having an electrical resistance value of 40 MΩ and the capacitor 28 having capacitance of 47000 pF are used.

FIG. 6 is a table showing image evaluation results according to the present exemplary embodiment and the first modification, the second modification, the third modification, the first comparative example, the third comparative example, and a fourth comparative example of the present exemplary embodiment. As shown in FIG. 6, the first modification includes the configuration in which capacitance of a capacitor connected in parallel to the Zener diode 19 is set to 500 pF, and the second modification includes the configuration in which capacitance of a capacitor connected in parallel to the Zener diode 19 is set to 3300 pF. Further, the third modification includes the configuration in which capacitance of a capacitor connected in parallel to the Zener diode 19 is set to 4700 pF. The first comparative example includes, as already described above, the configuration in which only the Zener diode 19 is connected to the pre-transfer guide 17, and the fourth comparative example includes a configuration in which the Zener diode 19 is not connected but only a capacitor having capacitance of 1000 pF is connected to the pre-transfer guide 17.

A column of Vp-p (V) in FIG. 6 indicates an amplitude of a voltage formed on the pre-transfer guide 17 when an AC voltage having 240 V and 60 Hz was applied from the AC power source 40 to the heating member 12 in the high temperature and high humidity environment (temperature of 30 degrees C. and humidity of 80%). A conveyance speed of the transfer material P was set to 150 mm/sec when the image evaluation was performed, and Xerox Vitality Multipurpose Paper (Letter size, 20 lb) left in the high temperature and high humidity environment was used as the transfer material P.

The image evaluation was conducted by checking whether an AC banding image was generated and whether transfer failure occurred due to a shortage of the transfer voltage formed at the transfer portion Nt. Evaluation criteria are as follows. Various images for evaluation were output, and an image in which the above-described image defect did not occur was evaluated as ○, an image of which image defect was in a practically acceptable degree was evaluated as Δ, and an image of which image defect was not in a practically acceptable degree was evaluated as x.

According to the present exemplary embodiment, the cleaner-less configuration is used, so that when transfer failure occurs, much toner remains on the photosensitive drum 1 after passing through the transfer portion Nt. Then, the toner remaining on the photosensitive drum 1 is not completely collected by the developing unit 5 and reaches again the transfer portion Nt. Thus the residual toner is transferred to a subsequent transfer material P and causes an image defect. According to the present exemplary embodiment, an image defect occurred on the subsequent transfer material P was evaluated to evaluate whether a transfer failure image is generated due to a shortage of the transfer voltage. However, evaluation of whether a transfer failure image is generated may be performed by comparing a toner image transferred from the photosensitive drum 1 to the transfer material P when the transfer voltage is in shortage at the transfer portion Nt with an image for evaluation which is originally transferred without being limited to the above-described method.

As illustrated in FIG. 6, the image defect did not occur in the present exemplary embodiment and the first and the second modifications according to the present exemplary embodiment. On the other hand, the AC banding images were generated in the first comparative example which does not include the capacitor 18 and the fourth comparative example which does not include the Zener diode 19 since the amplitudes Vp-p were not sufficiently suppressed compared to the present exemplary embodiment.

Further, in the third modification and the third comparative example, the amplitudes Vp-p were suppressed, and the AC banding image was not generated, but generation of the transfer failure image in a practically acceptable degree was confirmed at the leading edge portion of the transfer material P in the conveyance direction of the transfer material P. This is because, the capacitance of the capacitor is large, and thus a transfer electric current flowed through the capacitor 18 when the leading edge of the transfer material P entered the transfer portion Nt, and a rise in the transfer voltage at the transfer portion Nt was delayed as illustrated in FIG. 4. Thus, it is desirable that the capacitance of the capacitor 18 is set to 500 pF or more and 3300 pF or less in the configuration of the image forming apparatus 50 according to the present exemplary embodiment.

As described above, according to the present exemplary embodiment, the Zener diode 19 and the capacitor 18 are connected in parallel between the pre-transfer guide 17 and the ground, and thus generation of an AC banding image can be suppressed without increasing the capacitance of the capacitor 18. Since generation of an AC banding image can be suppressed without increasing the capacitance of the capacitor 18, occurrence of transfer failure due to a shortage of the transfer voltage formed at the transfer portion Nt can be suppressed.

According to the present exemplary embodiment, the image forming apparatus 50 including the cleaner-less configuration is described. However, the configuration is not limited to the above-described one, and an image forming apparatus including a collection member for collecting toner remaining on the photosensitive drum 1 can obtain an effect similar to that according to the present exemplary embodiment by using the configuration of the present exemplary embodiment.

Further, according to the present exemplary embodiment, the conductive member is described using the metal pre-transfer guide 17. However, a guide having constant resistance such as a mold may be used as a conductive member without being limited to the above-described one. A conductive member can flow an electric current from the transfer portion Nt to the Zener diode 19 if the electrical resistance thereof is 106Ω or less, and it is more desirable that the conductive member has electrical resistance of 103Ω or less.

Figure 7:
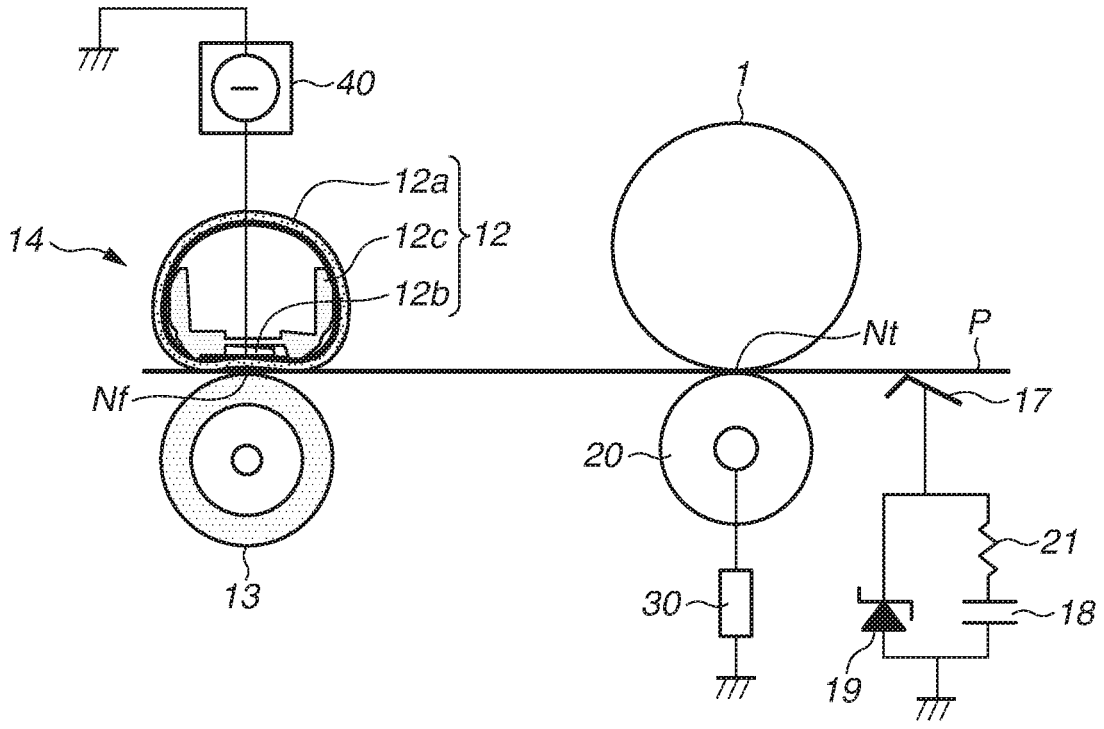
FIG. 7 is a schematic diagram illustrating a configuration according to a fourth modification.

Further, as a fourth modification illustrated in FIG. 7, an electrical resistance 21 (a second resistance element) may be connected in series between the capacitor 18 and the pre-transfer guide 17, and the electrical resistance 21 and the capacitor 18 may be connected in parallel to the Zener diode 19. In this case, an effect of the capacitor 18 is weakened by providing the electrical resistance 21, so that occurrence of the above-described transfer failure can be suppressed when the capacitance of the capacitor is increased than that according to the present exemplary embodiment.

Figure 8:
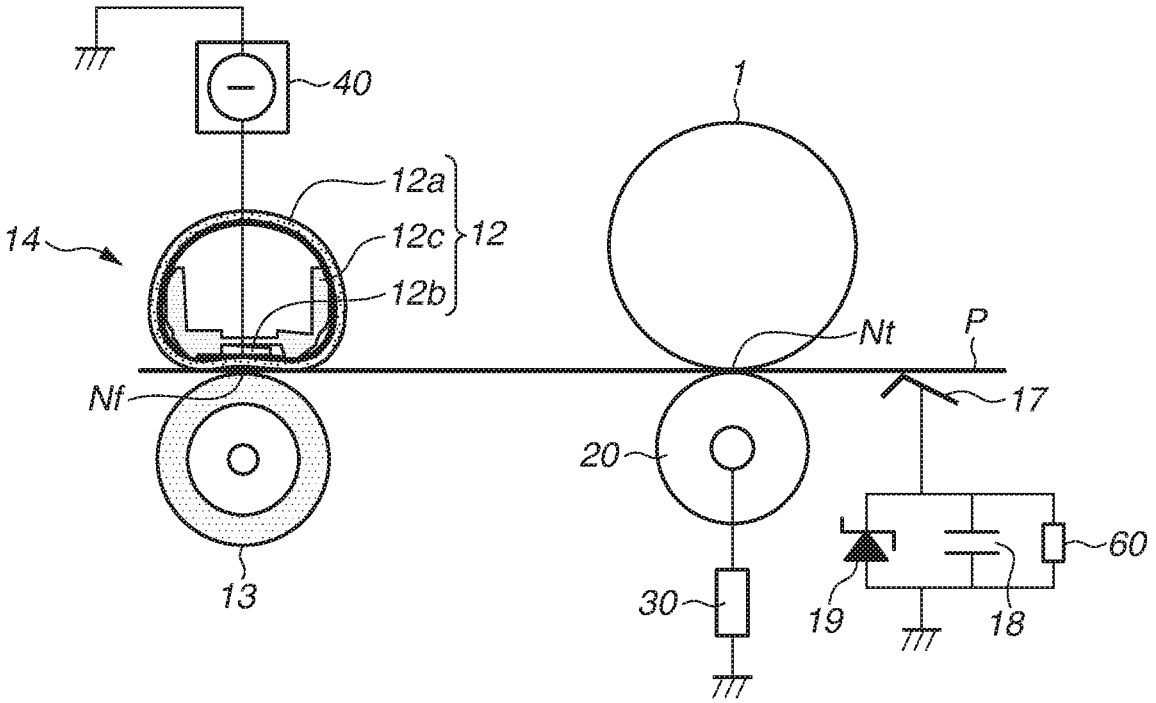
FIG. 8 is a schematic diagram illustrating a configuration according to a fifth modification.

Further, as a fifth modification illustrated in FIG. 8, a power source 60 may be connected in parallel to the Zener diode 19 and the capacitor 18. The configuration in which the power source 60 applies a voltage to the pre-transfer guide 17 can stably maintain the cathode side of the Zener diode 19 at the breakdown voltage when the breakdown voltage of the Zener diode is set to a greater value than that according to the present exemplary embodiment.

On the other hand, the configuration according to the fifth modification needs to additionally provide the power source 60 with respect to the configuration according to the present exemplary embodiment. The configuration which can maintain the pre-transfer guide 17 at the breakdown voltage of the Zener diode 19 without providing the power source 60 as the present exemplary embodiment can achieve miniaturization, space saving, and cost reduction of an image forming apparatus.

According to the present exemplary embodiment, the Zener diode 19 is used as a constant voltage element, however, an avalanche diode, a varistor, and the like may be used as an element which can obtain an effect similar to that of the Zener diode 19.

According to the first exemplary embodiment, the configuration is described in which the pre-transfer guide 17 arranged on the upstream side than the transfer portion Nt in the conveyance direction of the transfer material P is used as a conductive member. In contrast, according to a second exemplary embodiment, a pre-fixing guide 27 arranged on an upstream side of a fixing portion Nf and a downstream side of a transfer portion Nt in a conveyance direction of a transfer material P is used as a conductive member. More specifically, the present exemplary embodiment is different from the first exemplary embodiment in that a Zener diode 219 and a capacitor 218 are connected in parallel and arranged between the pre-fixing guide 27 and the ground, and a resistance 22 is arranged between the pre-transfer guide 17 and the ground. In the following description, parts in common with the first and the second exemplary embodiments are denoted with the same reference numerals, and the descriptions thereof are omitted.

Figure 9:
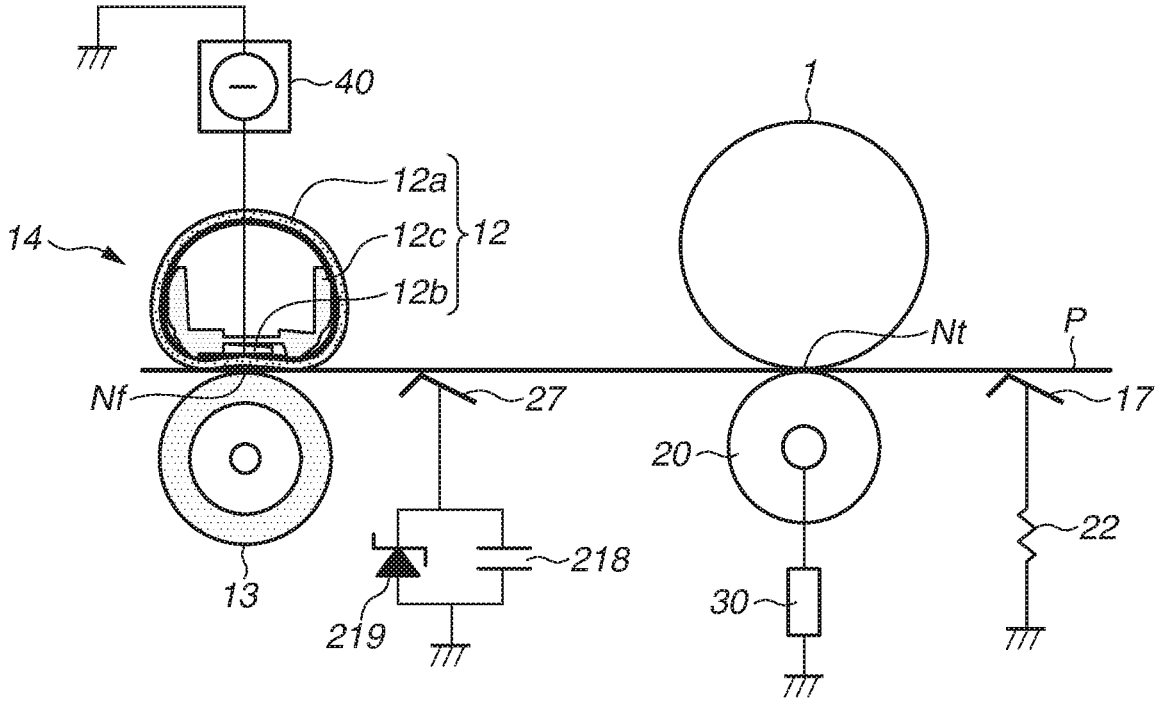
FIG. 9 is a schematic diagram illustrating a peripheral configuration of a transfer portion and a fixing unit according to a second exemplary embodiment.

FIG. 9 is a schematic diagram illustrating a peripheral configuration of a fixing portion and a transfer portion according to the present exemplary embodiment. As illustrated in FIG. 9, the pre-transfer guide 17 is electrically connected to the ground via the resistance 22 (a first resistance element) having electrical resistance of 500 MΩ. This configuration suppresses an electric current flowing from the transfer roller 20 to the photosensitive drum 1 from flowing to the ground via the transfer material P and the pre-transfer guide 17 when a transfer material P having low electrical resistance is nipped by the transfer portion Nt in the high temperature and high humidity environment. Further, in order to suppress charging by friction between the pre-transfer guide 17 and the transfer material P, the pre-transfer guide 17 constituted of a metal member is used according to the present exemplary embodiment.

Further, as illustrated in FIG. 9, according to the present exemplary embodiment, the pre-fixing guide 27 is used as a conductive member which is in contact with the transfer material P when the transfer material P is nipped by the transfer portion Nt and the fixing portion Nf. The pre-fixing guide 27 is a guide member which is arranged on an upstream side of the fixing portion Nf in the conveyance direction of the transfer material P to guide the transfer material P to the fixing portion Nf by being in contact with the transfer material P and is constituted of a metal member. The capacitor 218 and the Zener diode 219 are connected in parallel and arranged between the pre-fixing guide 27 and the ground. According to the present exemplary embodiment, the Zener diode 219 having a breakdown voltage of 400 V and the capacitor 218 having capacitance of 1000 pF are used as with the first exemplary embodiment.

FIG. 10 is a table showing image evaluation results according to the present exemplary embodiment, a fifth comparative example, a sixth comparative example, and a seventh comparative example. An image evaluation method similar to that according to the first exemplary embodiment was used. However, a transfer failure image in FIG. 10 is a transfer failure image generated due to a shortage of the transfer voltage formed at the transfer portion Nt when the transfer material P is brought into contact with the pre-fixing guide 27. More specifically, a transfer failure image is an image defect occurring when the transfer voltage at the transfer portion Nt is in shortage because a transfer electric current flowing from the transfer roller 20 to the photosensitive drum 1 at the transfer portion Nt flows into the capacitor via the transfer material P and the pre-fixing guide 27.

The fifth comparative example includes a configuration in which the pre-fixing guide 27 is connected not to the capacitor 218 but only to the Zener diode 219, and the sixth comparative example includes a configuration in which the pre-fixing guide 27 is not connected to the Zener diode 219 but only to the capacitor having capacitance of 1000 pF. Further, the seventh comparative example includes a configuration in which the pre-fixing guide 27 is not connected to the Zener diode 219 but only to the capacitor having capacitance of 10000 pF. Other configurations according to the fifth to the seventh comparative examples are similar to that according to the present exemplary embodiment, and the descriptions thereof are omitted.

As illustrated in FIG. 10, an image defect did not occur in the configuration according to the present exemplary embodiment. On the other hand, the AC banding images were generated in the fifth comparative example which does not include the capacitor 218 and the sixth comparative example which does not include the Zener diode 219 as with the first and the fourth comparative examples according to the first exemplary embodiment.

Further, in the seventh comparative example, the AC banding image was not generated, however, the transfer failure image was generated. This is due to a shortage of the transfer voltage at the transfer portion Nt since the capacitance of the capacitor is large, and thus an electric current flowed through the transfer portion Nt flowed into the capacitor via the transfer material P and the pre-fixing guide 27 when the transfer material P was brought into contact with the pre-fixing guide 27. In the configuration according to the present exemplary embodiment, it is desirable that the capacitance of the capacitor 218 is set to 500 pF or more and 3300 pF or less as with the first exemplary embodiment.

According to the present exemplary embodiment, an element which maintains the pre-fixing guide 27 at the breakdown voltage when a voltage is applied from the transfer power source 30 to the transfer roller 20 to transfer a toner image from the photosensitive drum 1 to the transfer material P is used as the Zener diode 219 as with the first exemplary embodiment. In other words, the Zener diode 219 can maintain the cathode side at the breakdown voltage by an electric current flowing from the transfer portion Nt to the Zener diode 219 via the transfer material P having low electrical resistance and the pre-fixing guide 27.

As described above, according to the present exemplary embodiment, the Zener diode 219 and the capacitor 218 are connected in parallel between the pre-fixing guide 27 and the ground, and accordingly, generation of an AC banding image can be suppressed without increasing the capacitance of the capacitor 218. Since generation of an AC banding image can be suppressed without increasing the capacitance of the capacitor 218, occurrence of transfer failure due to a shortage of the transfer voltage formed at the transfer portion Nt can be suppressed.

According to the present exemplary embodiment, the conductive member is described using the pre-fixing guide 27 constituted of the metal member. However, a guide having constant resistance such as a mold may be used as a conductive member without being limited to the above-described one. A conductive member can flow an electric current from the transfer portion Nt to the Zener diode 219 if the electrical resistance thereof is 106Ω or less, and it is more desirable that the conductive member has electrical resistance of 103Ω or less.

Further, as in the fourth modification according to the first exemplary embodiment, an electrical resistance may be connected between the capacitor 218 and the pre-fixing guide 27, and the electrical resistance and the capacitor 218 may be connected in parallel to the Zener diode 219 according to the present exemplary embodiment. In this case, an effect of the capacitor 218 is weakened by providing the electrical resistance, so that occurrence of the above-described transfer failure can be suppressed when the capacitance of the capacitor is increased than the value according to the present exemplary embodiment.

According to the present exemplary embodiment, the Zener diode 219 is used as a constant voltage element, however, an avalanche diode, a varistor, and the like may be used as an element which can obtain an effect similar to that of the Zener diode 219.

Further, according to the present exemplary embodiment, the configuration is described in which the pre-fixing guide 27 which is disposed between the transfer portion Nt and the fixing portion Nf and guides the transfer material P to the fixing portion Nf is used as a conductive member. However, the conductive member is not limited to the above-described one and may be a member which is in contact with the transfer material P nipped by the transfer portion Nt and the fixing portion Nf. For example, a discharging member which is arranged between the transfer portion Nt and the fixing portion Nf to eliminate electricity of the transfer material P after passing through the transfer portion Nt may be used as the conductive member, and the Zener diode 219 and the capacitor 218 may be connected in parallel between the discharging member and the ground.

The present invention is described based on the exemplary embodiments adapted to a monochromatic image forming apparatus, however, the present invention is not limited to the above-described exemplary embodiments. The present invention can be applied to an image forming apparatus which includes a transfer member for transferring a toner image from an image bearing member to a transfer material P and a fixing unit. In other words, the present invention can be applied to a color image forming apparatus as illustrated in FIG. 11, and an effect similar to that according to the above-described exemplary embodiments can be obtained.

Figure 11:
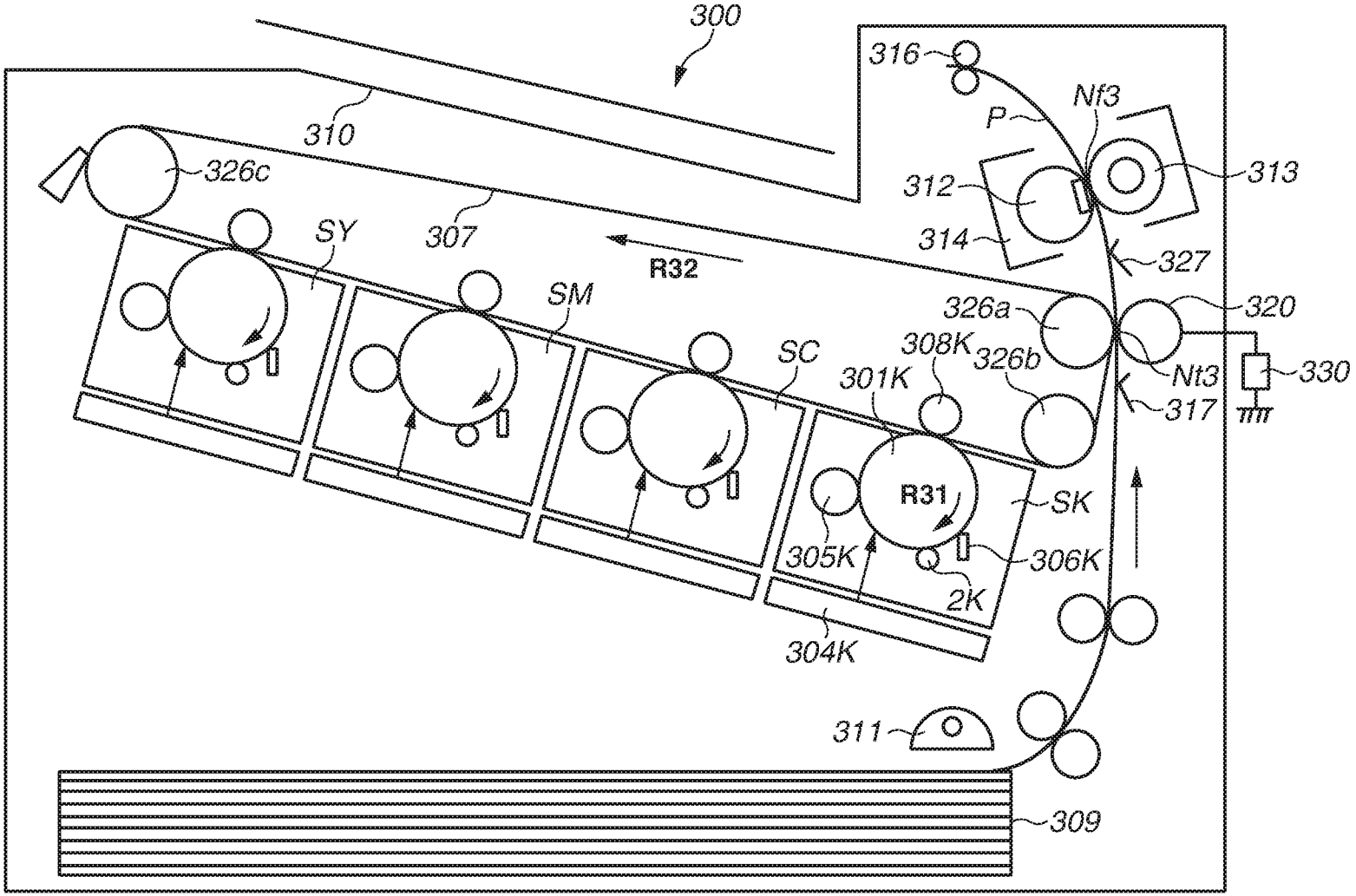
FIG. 11 is a cross-sectional view illustrating a configuration of an image forming apparatus according to another exemplary embodiment.

FIG. 11 is a schematic cross-sectional view illustrating an image forming apparatus 300 according to the present exemplary embodiment. As illustrated in FIG. 11, the image forming apparatus 300 according to the present exemplary embodiment is a color image forming apparatus in which image forming units SY, SM, SC, and SK for forming images in respective colors of yellow (Y), magenta (M), cyan (C), and black (K) are arranged at constant intervals. According to the present exemplary embodiment, configurations and operations of the image forming units SY, SM, SC, and SK are substantially the same except that colors of images to be formed are different. Thus, the configuration of the image forming apparatus 300 according to the present exemplary embodiment is described below using the image forming unit SK.

In the image forming apparatus 300 according to the present exemplary embodiment, an image signal transmitted from an information device such as a personal computer (not illustrated) is received in the image forming apparatus 300 and then is transmitted to a control unit not illustrated after analysis. Then, the control unit not illustrated controls various units, and thus an image forming operation is started in the image forming apparatus 300.

The image forming unit SK includes a photosensitive drum 301K as a drum type photosensitive member, a charging roller 302K as a charging unit, a developing roller 305K as a developing unit, and a cleaning unit 306K. When the image forming operation is started, the photosensitive drum 301K is driven and rotated at a predetermined peripheral speed in an arrow R31 direction shown in FIG. 11 and uniformly subjected to charging processing to a predetermined potential having a predetermined polarity (a negative polarity according to the present exemplary embodiment) by the charging roller 302K in the rotation process. Subsequently, the photosensitive drum 301K is exposed to light corresponding to the image signal by an exposure unit 304K, and thus an electrostatic latent image is formed on a surface of the photosensitive drum 301K. The electrostatic latent image formed on the surface of the photosensitive drum 301K is developed by toner supplied from the developing roller 305K, and a toner image is formed on the photosensitive drum 301K.

An endless intermediate transfer belt 307 as an image bearing member stretched by stretching rollers 326*a* to 326*c* as stretching members is arranged to face the photosensitive drum 301K, and the intermediate transfer belt 307 is driven and rotated in an arrow R32 direction shown in FIG. 11. A primary transfer roller 308K for pressing the intermediate transfer belt 307 to the photosensitive drum 301K is arranged on an inner circumferential surface side of the intermediate transfer belt 307. A primary transfer portion is formed at a position at which the intermediate transfer belt 307 pressed by the primary transfer roller 308K abuts on the photosensitive drum 301K. The toner image formed on the photosensitive drum 301K is primarily transferred from the photosensitive drum 301K to the intermediate transfer belt 307 on a process for passing through the primary transfer portion. The respective color toner images are thus primarily transferred to the intermediate transfer belt 307 by the respective image forming units SY, SM, SC, and SK, and a toner image in a plurality of colors corresponding to a target color image is formed on the intermediate transfer belt 307.

A secondary transfer roller 320 as a transfer member is arranged to face the stretching roller 326*a* via the intermediate transfer belt 307 as the image bearing member, and a secondary transfer portion Nt3 as a transfer portion is formed on a position at which the intermediate transfer belt 307 abuts on the secondary transfer roller 320. The secondary transfer roller 320 is connected to a transfer power source 330, and the control unit not illustrated controls the transfer power source 330 to apply a voltage to the secondary transfer roller 320, so that the toner image in the plurality of colors is secondarily transferred from the intermediate transfer belt 307 to the transfer material P.

The transfer material P stored in a sheet feeding cassette 309 is supplied from the sheet feeding cassette 309 by a sheet feeding roller 311 and conveyed to the secondary transfer portion Nt3 in accordance with timing when the toner image in the plurality of colors formed on the intermediate transfer belt 307 reaches the secondary transfer portion Nt3. The transfer material P on which the toner image in the plurality of colors is secondarily transferred at the secondary transfer portion Nt3 is conveyed to a fixing unit 314 and heated and pressed by a heating unit 312 and a pressing unit 313, so that the respective color toners are melted, mixed and then fixed to the transfer material P. Subsequently, the transfer material P is discharged to a sheet discharge tray 310 as a stacking unit by a sheet discharge roller 316.

The color image forming apparatus 300 as described above can include conductive members such as a pre-transfer guide 317 and a pre-fixing guide 327 illustrated in FIG. 11 for being contact with the transfer material P nipped between the transfer portion Nt and the fixing portion Nf. Further, an effect similar to that according to the first and the second exemplary embodiments can be obtained by providing a Zener diode and a capacitor connected in parallel between the pre-transfer guide 317 and the ground.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-216702, filed Nov. 9, 2017, which is hereby incorporated by reference herein in its entirety.

What is claimed is:

1. An image forming apparatus comprising:

an image bearing member configured to bear a toner image;

a transfer member configured to form a transfer portion by abutting on the image bearing member and transfer the toner image born by the image bearing member to a transfer material at the transfer portion;

a transfer power source configured to apply a voltage to the transfer member;

a fixing unit which is disposed downstream of the transfer member in a conveyance direction of the transfer material and includes a heating member configured to heat the transfer material and a pressing member configured to form a fixing portion by being in contact with the heating member and to fix the toner image to the transfer material nipped by the fixing portion by being applied with an alternate current (AC) voltage;

a conductive member arranged upstream of the fixing portion in the conveyance direction of the transfer material and configured to contact the transfer material;

a capacitor disposed between the conductive member and ground; and a constant voltage element that is not connected to the transfer member, is arranged in parallel with the capacitor between the conductive member and the ground, and is maintained at a predetermined voltage on a side connected to the conductive member in a state in which the toner image is transferred to the transfer material nipped by the fixing portion and the transfer portion, wherein the constant voltage element is maintained at the predetermined voltage on the side connected to the conductive member by an electric current flowing from the transfer portion via the transfer material and the conductive member in a state where the transfer material is nipped by the fixing portion and the transfer portion and the transfer power source applies the voltage to the transfer member, and wherein the constant voltage element is not maintained at the predetermined voltage on the side connected to the conductive member in a state where the transfer material is not nipped by the fixing portion and the transfer portion and the transfer power source applies the voltage to the transfer member.

2. The image forming apparatus according to claim 1, wherein the transfer power source is configured to apply a direct current (DC) voltage to the transfer member, and wherein an electric current flows from the transfer portion to the conductive member via the transfer material in a state in which the DC voltage is applied from the transfer power source to the transfer member, and the toner image is transferred from the image bearing member to the transfer material.

3. The image forming apparatus according to claim 1, wherein the constant voltage element is a Zener diode, and the Zener diode is electrically connected to the ground on an anode side and connected to the conductive member on a cathode side.

4. The image forming apparatus according to claim 1, wherein the conductive member is arranged of the transfer portion in the conveyance direction of the transfer material.

5. The image forming apparatus according to claim 4, wherein the conductive member is a guide member configured to be in contact with the transfer material and guide the transfer material to the fixing portion.

6. The image forming apparatus according to claim 4, further comprising a guide member which is arranged upstream of the transfer portion in the conveyance direction of the transfer material and is configured to guide the transfer material to the transfer portion by being in contact with the transfer material; and a resistance element connected between the guide member and the ground.

7. The image forming apparatus according to claim 1, wherein the conductive member is a guide member which is arranged upstream of the transfer portion in the conveyance direction of the transfer material and is configured to guide the transfer material to the transfer portion by being in contact with the transfer material.

8. The image forming apparatus according to claim 1, wherein capacitance of the capacitor is 500 pF or more and 3300 pF or less.

9. The image forming apparatus according to claim 1, further comprising a resistance element connected to the capacitor in series between the conductive member and the capacitor, wherein the resistance element and the capacitor are connected in parallel to the constant voltage element.

10. The image forming apparatus according to claim 1, wherein the conductive member is not directly connected to the transfer power source.

11. The image forming apparatus according to claim 1, wherein the heating member is arranged to face the transfer material nipped by the fixing portion and includes a heating element which generates heat by being applied with the alternate current (AC) voltage and heats the heating member.

12. The image forming apparatus according to claim 11, wherein the heating member includes a flexible member having a cylindrical shape covering the heating element, and the heating element is arranged on a position facing the pressing member via the flexible member.

13. The image forming apparatus according to claim 12, further comprising a charging unit configured to charge the photosensitive member by being in contact with the photosensitive member, wherein a blade abutting on the photosensitive member is not disposed between a position at which the photosensitive member is in contact with the charging unit and the transfer portion in a rotation direction of the photosensitive member.

14. The image forming apparatus according to claim 1, further comprising a developing unit configured to supply the toner image to the image bearing member, wherein the image bearing member is a photosensitive member on which an electrostatic latent image is developed by the developing unit.

15. The image forming apparatus according to claim 1, further comprising a photosensitive member, wherein the image bearing member is an endless intermediate transfer belt which bears the toner image transferred from the photosensitive member.

* * * * *